US011234064B2

(12) United States Patent
Levinsohn

(10) Patent No.: US 11,234,064 B2
(45) Date of Patent: Jan. 25, 2022

(54) MICROPHONE ACCESSORY, MICROPHONE ACCESSORY ASSEMBLY AND METHOD OF USING A MICROPHONE

(71) Applicant: Steven Mark Levinsohn, Los Angeles, CA (US)

(72) Inventor: Steven Mark Levinsohn, Los Angeles, CA (US)

( * ) Notice: Subject to any disclaimer, the term of this patent is extended or adjusted under 35 U.S.C. 154(b) by 0 days.

(21) Appl. No.: 16/292,158

(22) Filed: Mar. 4, 2019

(65) Prior Publication Data

US 2020/0084530 A1 Mar. 12, 2020

Related U.S. Application Data

(62) Division of application No. 14/597,366, filed on Jan. 15, 2015, now Pat. No. 10,225,636.

(30) Foreign Application Priority Data

Jan. 15, 2014 (ZA) ..... 2014/00306

(51) Int. Cl.
*H04R 1/08* (2006.01)
*G09F 23/00* (2006.01)
*H04R 1/02* (2006.01)

(52) U.S. Cl.
CPC ..... *H04R 1/08* (2013.01); *G09F 23/00* (2013.01); *H04R 1/028* (2013.01)

(58) Field of Classification Search
CPC ..... H04R 1/1041; H04R 2201/107; H04R 1/1016; H04R 1/1025; H04R 1/105; H04R 2420/09; H04R 2201/105; H04R 2420/07; H04R 25/556; H04R 25/558; H04R 25/602; H04R 25/603; H04R 25/30; H04R 1/04; H04R 2499/11; H04R 25/552; H04R 1/021; H04R 1/028; H04R 1/08; H04R 1/406; H04R 2201/401; H04R 17/00; H04R 1/1008; H04R 1/1058; H04R 1/1083;
(Continued)

(56) References Cited

U.S. PATENT DOCUMENTS 7,783,069 B1 * 8/2010 Miller ..... H04R 1/342 381/354
2001/0054922 A1 12/2001 Ikeda
(Continued)

FOREIGN PATENT DOCUMENTS

JP 2007259444 A 10/2007
WO 2005/093698 A2 10/2005

*Primary Examiner* — Lun-See Lao

(57) ABSTRACT

This invention relates to microphone accessories, particularly microphone flags, for use with a hand-held microphone having a bulbous head and elongate stalk extending therefrom. The accessory has at least one body having at least one display face for displaying at least a first communication; at least one attachment formation for attaching the body to the microphone; and at least one display member for displaying at least a second communication, wherein the at least one display member is permanently or removably attachable to the body and/or the microphone, and wherein the at least one display member is configured to extend and/or supplement the at least one display face of the body, in use. The invention also relates to a method of using a microphone and to a microphone accessory apparatus.

13 Claims, 10 Drawing Sheets

(58) Field of Classification Search
CPC ..... H04R 2201/021; H04R 2225/33; H04R 2225/51; H04R 2430/23; H04R 2460/13; H04R 2499/13; H04R 25/606; H04R 29/008; H04R 3/005; H04R 5/033
USPC ..... 381/91, 92
See application file for complete search history.

(56) References Cited

U.S. PATENT DOCUMENTS

| | | | | |
|---|---|---|---|---|
| 2008/0205684 | A1* | 8/2008 | Wilson | H04R 1/08 381/388 |
| 2009/0134223 | A1 | 5/2009 | Matthews | |
| 2009/0248410 | A1 | 10/2009 | Wingard | |
| 2011/0054922 | A1* | 3/2011 | Gaines | G06Q 30/02 705/1.1 |
| 2011/0087135 | A1 | 4/2011 | Ferzli | |
| 2013/0308796 | A1* | 11/2013 | Levinsohn | H04R 1/04 381/122 |
| 2015/0098602 | A1* | 4/2015 | Levinsohn | H04R 1/08 381/361 |

* cited by examiner

MICROPHONE ACCESSORY, MICROPHONE ACCESSORY ASSEMBLY AND METHOD OF USING A MICROPHONE

FIELD OF THE INVENTION

The invention relates generally to microphone accessories, particularly to microphone flags for use with microphones of the hand-held variety and to a microphone accessory assembly and a method of using a microphone.

BACKGROUND OF THE INVENTION

Microphone accessories, such as microphone flags, are attached to handles of microphones, adjacent the head thereof, to display a message to an audience, in person, or primarily when the microphone flag is filmed and displayed to an audience of viewers.

Conventionally, microphone flags are cuboidal, triangular, or the like having a plurality of display panels displaying communications in the form of printed media, for example, a printed name of a television station associated with the microphone. In some example embodiments, the panels display advertising media in the form of printed communications so as to generate advertising revenue, for example, a television station associated with an interview being filmed and broadcast to millions of viewers may levy an advertising fee for placement of an advertisement of a particular company onto the flag being filmed and broadcast.

One problem with conventional microphone flags is that only one panel of the flag is suitable for displaying a static image, such as an advertisement, when the microphone flag is in use, for example, during an interview. Due to this limitation, a broadcaster cannot monetize air-time for advertising as effectively as desired. This problem is exacerbated should the broadcaster elect to retain its logo or brand on the microphone flag as they would have to make a selection on the placement of a third party advertisement versus their own logo or branding on the microphone flag.

It is an object of the present invention to provide a microphone flag which addresses these problems.

SUMMARY OF THE INVENTION

According to a first aspect of the invention, there is provided a microphone accessory for use with a microphone, the microphone accessory comprising:

- at least one body having at least one display face for displaying at least a first communication;
- at least one attachment formation for attaching the body to the microphone; and
- at least one display member for displaying at least a second communication, wherein the at least one display member is permanently or removably attachable to the body and/or the microphone, and wherein the at least one display member is configured to extend and/or supplement the at least one display face of the body, in use.

The at least one display member may be configured to extend the at least one display face of the body, where the extension is substantially planarly and/or in shape and/or dimension, in use.

The shape and/or dimension may be in the form of an indicia and/or logo and/or product and/or trade mark and/or trade name, or the like The display member may be configured to comprise at least one display face, where the display face may display at least one static non-electronically variable communication and/or at least one electronically variable communication on at least one side thereof, using a static non-electronically variable display and/or an electronically variable display device, respectively, in use.

The at least one display member may be configured to display at least a second communication and a third communication, whether static and/or dynamic, using the first display face of the first side of the display member to display at least the second communication and using the second display face of the second side of the same display member to display at least the third communication, in use.

The display face may display at least one static non-electronically variable first communication, and/or may comprise at least one display screen suitable for displaying an electronically variable first communication; and/or wherein the display member may be configured to display at least one static non-electronically variable second communication, and/or comprises at least one display screen suitable for displaying an electronically variable second communication.

The at least one display member may be configured to comprise at least one display face on at least one side thereof, where the at least one display face is configured to comprise at least one attaching formation for attaching thereto, permanently or removably, using one or more attachment means, including magnetic clips and/or magnets and/or magnetized paper and/or adhesive-backed paper and/or frictional fitting clips, at least one display and/or at least one display device, where the at least one display comprises at least one static non-electronically variable communication using a static non-electronically variable display and/or where the at least one display device comprises and/or includes at least one electronically variable communication and/or at least one projected communication and/or at least one virtual reality communication and/or at least one augmented reality communication, using at least one of an electronically variable display device and/or an image projection device and/or a virtual reality communication display device and/or an augmented reality display device, respectively, in use.

The at least one display member may be configured to comprise at least one display face on at least one side thereof, where the at least one display face is configured to comprise at least one attaching formation for attaching thereto, permanently or removably, using one or more attachment means, including magnetic clips and/or magnets and/or magnetized paper and/or adhesive-backed paper and/or frictional fitting clips, at least one additional display member comprising at least one display face, where the at least one additional display member and/or display face comprises at least one static non-electronically variable communication and/or at least one electronically variable communication and/or at least one projected communication and/or at least one virtual reality communication and/or at least one augmented reality communication, on at least one side thereof, using a static non-electronically variable display and/or an electronically variable display device and/or an image projection device and/or a virtual reality communication display device and/or an augmented reality display device, respectively, in use.

The at least one static non-electronically variable communication may be in the form of printed media, and/or two-dimensional and/or three-dimensional objects.

The microphone accessory may comprise suitable circuitry, drivers, power source, and a processor operable to control the display screen/s of the display face and/or the display member so as to display at least electronically variable first and second communications in the form of advertising content thereon.

The microphone accessory may comprise a memory storing at least electronically variable first and second communications, and/or an external memory port for receiving an external storage device storing at least electronically variable first and second communications, and/or a wireless module for wirelessly receiving at least electronically variable first and second communications, and/or a wired port, for received at least electronically variable first and second communications in a hard wired fashion.

The processor may be configured to control the at least electronically variable first and second communications to either be different or to be identical in which case the processor is further configured to maintain the at least identical first and second communications on the display screens of the display face and the display member respectively or merge the display of the at least identical first and second communications across the display screens of the display face and the display member respectively.

The static non-electronically variable first and second communications may be in the form of printed media, and/or two-dimensional and/or three-dimensional objects.

The display member may be removably and/or displaceably attachable to the body, adjacent the display face. The at least one display member may be electromechanically displaceable via a suitable electromechanical arrangement, for example, comprising gears.

The accessory may comprise attaching formations in the form of magnetic clips and/or frictional fitting clips, for removably attaching the display member thereto so as to planarly extend the display face, in use.

The accessory may comprise a hinge, wherein the display member is attachable to the hinge so as to be hingedly displaceable, in use, between a first position in which the display member is substantially transverse to the display face and a second position in which the display member is substantially co-planar with the display face so as to extend the display face substantially planarly, in use.

The body may be cuboid, or triangular, having four planar surfaces each defining a display face or having three planar surfaces each defining a display face, respectively, and wherein the display member is substantially planar and is attachable adjacent an edge of the body, proximate two display faces, at a hinge so as to be hingedly displaceable, in use, between the first and second positions.

The display member may be hingedly displaceable about a first hinge axis located at the edge of the body, and wherein the display member is further rotatable at the hinge about a second hinge axis substantially transverse to the first hinge axis.

The attachment formation may be in the form of a central passage extending through the body, parallel to the first hinge axis, wherein a handle of the microphone is receivable therein for attachment, in use.

The attachment formation may be in the form of a hollow opening in the body, wherein the head of the microphone is axially receivable in the body, for attachment to the microphone, in use.

The display member may be manually actuable to be displaceable between the at least first and second positions, and/or wherein the accessory comprises an electro-mechanical displacement arrangement operative to displace the display member between the at least first and second positions automatically in response to a suitable control signal.

The attachment formation may be a ring-like attachment formation attachable to the head of the microphone, in use. The ring-like attachment formation may be a resiliently flexible ring for attachment to microphone heads of different sizes.

The display member may be spaced from the body and/or display face by way of a suitable spacer.

According to a second aspect of the invention, there is provided a method of using a microphone, the method comprising:

providing a microphone accessory onto a microphone, wherein the microphone accessory comprises at least one body having at least one display face for displaying at least one communication; an attachment formation for attaching the microphone accessory to the microphone; and at least one display member fixedly or removably attached to the body; and extending or supplementing the display face of the microphone accessory by operating a display member fixedly or removably attachable to the microphone accessory.

If the display member is removably attachable to the microphone accessory, the method may comprise attaching the display member to adjacent an edge of the display face of the microphone accessory; and wherein if the display member is fixedly attachable to the microphone accessory adjacent an edge of the display face of the microphone accessory, the method may comprise displacing the display member in about a hinge so as to be substantially planar with the display face.

According to a third aspect of the invention, there is provided a microphone accessory for use with a microphone having an elongate handle and a head, the microphone accessory comprising:

an attachment formation in the form of a ring for attaching the accessory to the head of the microphone, the attachment formation having a display face displaying at least one communication; and one or more display members displaying one or more communications attachable to the attachment device such that the one or more display members extend substantially radially outwardly from the head of the microphone, in use.

According to a fourth aspect of the invention, there is provided microphone accessory assembly for use with a microphone having an elongate handle and a head, the microphone accessory assembly comprising:

a microphone accessory having:

a ring-like attachment formation for attaching the accessory to the head of the microphone, in use; and one or more display members displaying one or more communications attachable to the attachment formation such that the one or more display members extend substantially radially outwardly from the head of the microphone, in use;

and a microphone windshield defining a central aperture for receiving the head of the microphone axially therein and one or more lateral slots for engagement with an interface between the one or more display members and the attachment formation and/or microphone head, wherein the microphone windshield comprises at least one communication provided on an operative face thereof.

The ring-like attachment formation may comprise one or more display panels displaying one or more communications, wherein the microphone windshield may comprise one or more display apertures provided at locations corresponding to locations of the one or more display panels of the microphone accessory when located on a head of a microphone, in use, such that the one or more display panels are visible through the one or more display apertures of the microphone windshield, in use.

DESCRIPTION OF THE INVENTION

Figure 1:
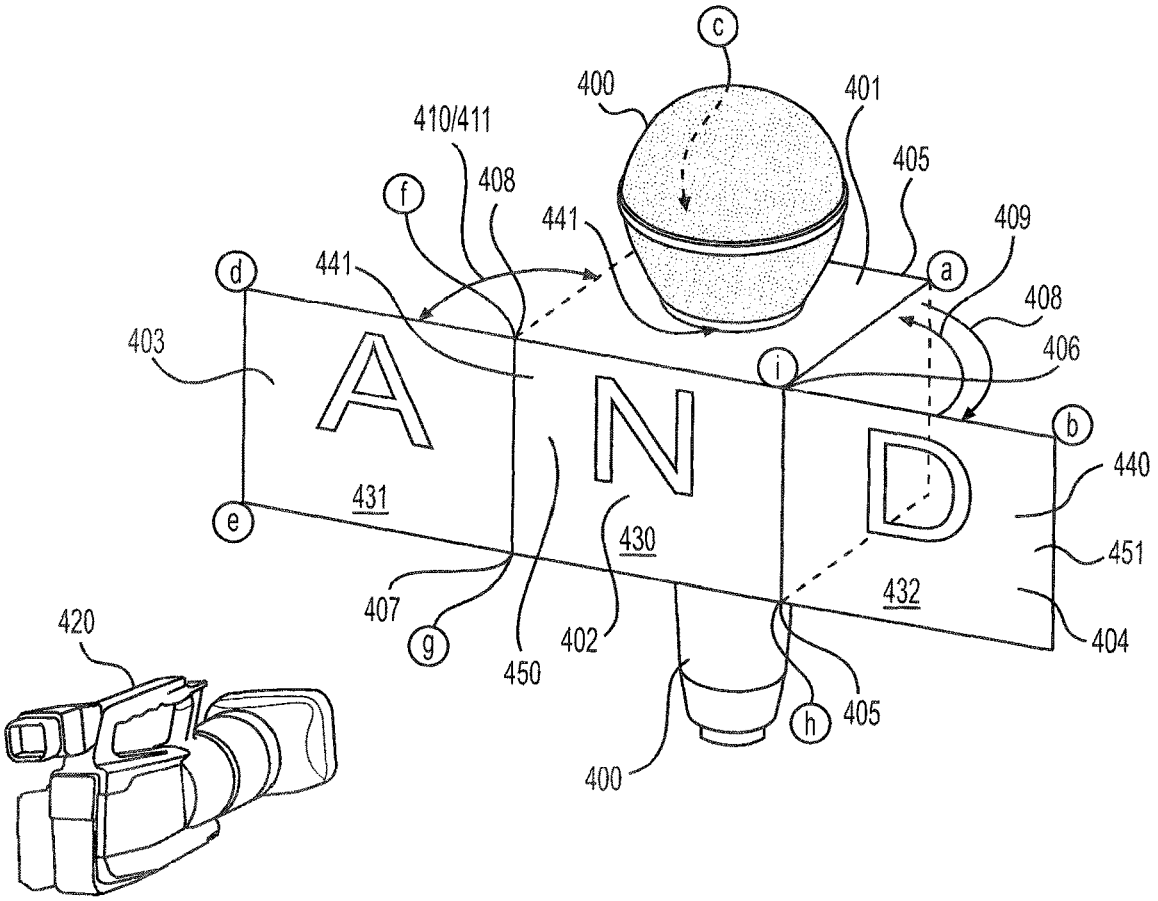
FIG. 1 illustrates a perspective view of a microphone accessory in accordance with an example embodiment of the invention.

The term "communication" as used herein at least comprises any indicia, marks, advertising, logo, brand, brand name, trade name, trade mark, symbol, drawing, illustration, coupon, promotional message, symbol, digit, letters, words, symbol sets, representations, graphics, images, intellectual property rights, 2D image, 3D image, 3D rendering or model, whether to scale or not, hologram, enhanced reality, virtual reality, augmented reality and or any other physical form or forms representing communications, data and/or information, whether permanent or temporary, whether static and/or dynamic and/or electronic and/or electromechanical and/or mechanical. As used herein, the singular may include the plural and vice versa.

A communication may be an electronic communication displayed using an electronic display device and/or a communication may be a non-electronically variable or static communication and/or a communication may be an electromechanically displaceable communication and/or a communication may be an augmented reality communication and/or a communication may be a virtual reality communication and/or a communication may be a projected communication. An electronically variable communication may be displayed using at least one electronic display device. A communication may be displayed using at least one laser beam and/or at least one projection device, such as a light emitting projector, and/or virtual reality device/s and/or augmented reality device/s.

A static communication may be displayed on and/or below the surface of a material such as paper, cardboard, plastic, vinyl, a wall, a painted surface, rubber, any combination of the preceding or any other suitable material/s, and may be printed on a suitable surface or material or compound. A static communication may be removably or permanently attached to a material. A static display includes a display surface on which a communication may be displayed by various suitable means including by printing onto the surface of the static display and/or by attaching a second display (such as paper with a communication displayed thereon to the surface of the static display using a suitable attachment means such as an adhesive) or other suitable static communication display. A removable static communication may be attached to a surface by a plurality of means, including by adhesive, pressure, friction, male-female attachment means, clips, and so on.

The term "transmitter" or "transmitted" as used herein means any device which transmits, radiates or distributes a signal, whether optical, video, filmed, radar, sonar, ultrasound, visual, infrared, acoustic, electric, magnetic, electromagnetic or otherwise manifested, whether digital and/or analogue and/or otherwise manifested.

The term "receiver" or "received" as used herein means any device which acquires and/or captures a signal(s) and or image(s) or a series of images (such as video images), whether visual, optical, radar, sonar, infrared, filmed, ultrasound, acoustic, electric, magnetic, electromagnetic or otherwise manifested, whether digital and or analogue or otherwise manifested. The receiver may use a photographic lens and associated imaging device(s) to capture images.

When used in appropriate context the term "device" comprises any transmitter and/or receiver and/or transceiver and/or electronic display device and/or electrical device and/or electromechanical device and/or mechanical device. A device and/or display device may include an electronic display device configured to display at least one image or a plurality of images, and may include the necessary software, hardware, circuitry, computer/s, power supply, data, data bases, input means, output means, connectors, transmission and/or reception means, ports, interfaces, and so on to display and/or use the necessary data. A device may include an electronically variable means comprising at least one light or illumination source or a plurality of illumination sources. A device may comprise at least one laser beam. A device may include a projector or a holographic display or a virtual reality display device or an augmented reality display device.

The term "image" includes a single image or a series of images, whether digital or analogue, whether on film or video or using other suitable means, whether two dimensional and/or three dimensional and/or holographic and/or virtual and/or augmented.

In this specification "to film" or to "video" means to capture an image, or a sequence of images, in a suitable manner, including chemical, magnetic, or optical, and in analogue and/or digital form; and "filming" and "film" or "videoed" and "video" (as a verb) have corresponding meanings. The filming or videoing of an image or a sequence of images may be achieved and or recorded by a camera. A camera includes recording the image of an object on a light-sensitive material or by a camera which is an electronic device for capturing images and converting them into electrical impulses or signals (analogue and or digital) or by other suitable means.

The terms "coupled", "coupled to" and "coupled with" as used herein means a relationship between or among two or more devices, any means described herein, the accessory/ies described herein, apparatus, files, programs, media, components, materials, networks, systems, subsystems and or means, comprising any one or more of (a) a connection and/or attachment whether direct or indirect, permanent or removable, or through one or more other devices, apparatus, files, cables, wireless, programs, media, components, networks, systems, sub-systems or means, magnet, adhesive, friction, male-female coupling, clip, velcro, means of attachment, means of connection (b) a communications relationship, whether direct or indirect or through one or more other devices, apparatus, files, programs, media, components, networks, systems, sub-systems or means, or (c) a functional relationship in which the operation of any one or more thereof depends, in whole or in part, of the operation of any one or more others thereof.

The term "processor" and or "processing" and or "controller" and or "controlling" as used herein means processing device(s), apparatus, programs, circuits, data, data bases, sensor/s, power supply, systems and sub-systems, whether implemented in hardware, software, circuitry or any combination thereof, and whether for processing analogue and/or digital data.

The term "data" or "communication" as used herein comprises any indicia, signals, information, marks, binary data, symbols, digits, letters, words, domains, symbol sets, digital data, analogue data, representations and any other physical form or forms representing information, whether permanent or temporary, whether visible, audible, acoustic, electric, magnetic, electromagnetic, infrared, binary, radar, laser, optical or otherwise manifested. The term "data" as used herein to represent certain information in one physical form shall be deemed to encompass any and all representations of the same information in a different form or forms.

As illustrated in FIG. 1, microphone 400 has attached thereto body 401. Body 401 may be comprised of at least one display face 402 and may preferably comprise a plurality of sides 403, 404 and 405. Microphone accessory 400*m*, particularly body 401 is configured such that at least one attachment formation 441 may be used for attaching the body 401, permanently or removably, to microphone 400. Display face 402 of body 401 may display at least a first communication 430, which communication may be a static communication and/or a dynamic communication/s. At least one display side 404 or display member 404 is permanently or removably attached to the body 401 and/or display face 402, where the at least one display member 404 is attachable or displaceable to extend at least one display member 402, substantially planarly in use, wherein the at least one display member 404 may display at least one second communication 432.

In a preferred embodiment, display member 404 may be hingedly attached to side 402 at 405/406 via a hinge and display member 403 may be hingedly attached to side 402 or display face 402 of the body 401 at 407/408 via a hinge. Display member 404 may be moved from a first position at point a in the direction of arrow 408 to the second position at point b, and back from second position at point b to first position at point a in the direction of arrow 409, or to any position between these two points, as and when desired by the user of microphone accessory 401.

Similarly, side 403 or display member 403 may be moved from original or first position at c in the direction of arrow 410 to the second position illustrated at point d, and back from second position d to first position c in the direction of arrow 411, as and when desired by the user of microphone accessory 401.

Differently defined, it will be noted that the display member 403 is attachable to a hinge 407/408 so as to be hingedly displaceable, in use, between a first position at first position c, in which the display member 403 may be substantially transverse to the display face 402, and a second position, at second position d, in which the display member 403 may be substantially co-planar and/or adjacent to display face 402 so as to extend the display face 402, in use. As such, the display area and/or shape of the accessory may be changed. The shape and/or display area i-h-g-f of display face 402 may be extended or increased to shape and/or area i-h-e-d, incorporating shape/area f-g-e-d of display member 403.

Camera 420 may film microphone 400 with accessory 401 attached thereto and broadcast or transmit the film to an audience of viewers. A traditional microphone flag will have sides or display faces that are perpendicular to one another in a fixed, non-movable position (not illustrated). As such, the filming of accessory 401, when configured as a traditional microphone flag, with display member 404 at position a and display member 403 at position c, will only or substantially show one display face, display face 402, which displays or communicates communication 430, to the camera 420 and the audience, and for practical purposes communications 431 and 432 will not be visible to the viewers of the filming. If the communication 432 on display member 402 is an advertisement and communication 431 on display member 403 is an advertisement, and the advertisements are priced according to the number of viewers that see those advertisements, then, in use, the advertisements or communications 431 and 432, will not be able to be charged for by the broadcaser or transmitter of the filming, as they may not be seen by the audience.

Significantly, the microphone accessory 401 is configured such that display member 404, including communication 432 (which may comprise a static communication and/or an electronically variable communication, and so on), may be moved or displaced, using at least one displacement means, such as by using human power or force or an electromechanical device, into substantial alignment with display face 402 and communication 430. As such, communication 432 may be charged for by the broadcaster as it will now be able to be filmed by the camera 420 and transmitted to the audience, and the broadcaster may charge for the advertisement based on a cost per thousand viewers, or in such other manner as the broadcaster deems fit. It follows that display member 403 displaying communication 431 may, simultaneously with display member 404 displaying communication 432, be displaced from position c to position d adjacent to display face 402 which may display communication 430. The potential revenue may be further increased by the simultaneous alignment of display member 403 and display member 404 with display face 402, thereby extending display face 402, and by the simultaneous display of communications 431, 432 and 430, where such simultaneous display of communications may be filmed and transmitted to an audience.

Further, by displacing display members 404 and 403 into substantial alignment with display face 402, competitors' microphone flags may be obscured or covered from the view of the camera 420, thereby affording the user of body 401 a competitive advantage.

Importantly, the potential size and/or area and/or shape of a communication may be increased and/or altered. For example, the communication desired by a communicator to be communicated to an audience may, for example, comprise the letters "A", "N" and "D". Used together, on a display face of a conventional microphone flag (not illustrated) having but one display panel or side typically visible, in use, the communication "AND" may be too small for the audience to see, or the advertiser may prefer a larger size display area for its communication or a different shape of display area.

As such, using the microphone accessory 401, the letter "A" maybe displayed using display member 403, the letter "N" may be displayed using display face 402 and the letter "D" may be displayed using display member 404. When display member 403 is opened to position d and display member 404 is opened to position b, then the combined area may accommodate at least one larger communication, which may spell out the larger communication "AND". The communicator or advertiser may then be satisfied with the larger format and size used to display its communication, and the broadcaster may charge a premium for the additional space used by the communicator or advertiser, should the broadcaser so wish. Alternatively, display member 403 may be used by a first communicator and display face 402 and display member 404 may be used by a second communicator to display a combined 402-404 communication, and so on.

It will be noted that a communication may comprise at least one static communication and/or at least one dynamic communication and/or at least one electronically variable communication, and so on. A communication may be attached to any display member or face, permanently or removably, directly or indirectly. At least one static non-electronically variable communication may be in the form of printed media and/or two dimensional object/s and/or three dimensional object/s. For example, at least one communication may be printed directly onto at least one display member of body 401 and/or by printing at least one communication on paper and/or vinyl and/or a plastic material and/or plastic coated material and/or photographic paper (whether matt or gloss or other finish type) or other suitable material and attaching at least one such communication, using permanent and/or removable adhesive, to at least one display member of body 401; alternatively, at least one communication may be attached to at least one display member magnetically, where magnetic paper may be used to display at least one static communication.

Body 401 may comprise all the necessary components including hardware, software, transmitters, receivers, processors, wires, wireless transmitters and/or receivers, power supply, CPU, circuits, computers, electronics, screen, timer, clock, components, data bases, storage, data and so on such that accessory 401 may be configured to display at least one electronic communication using at least one electronically variable display device. The processor may be configured to control at least a first electronically variable communication. The processor may be configured to control at least a first electronically variable communication and at least a second communication to either be different or to be identical, in which case the processor may be further configured to maintain at least the identical first and second communications on the display screens of the display face and/or the display member/s, respectively, or to merge the display of the at least identical first and second communications across the display screens of the display face and the display member/s, respectively.

A microphone accessory may be four sided (cuboid) or triangular (three sided) in shape, and may comprise at least one side displaceable in at least one direction. Alternatively, the microphone accessory may be comprised of a plurality of sides with a plurality of movable or displaceable display members, which display members may be movable in a plurality of directions.

Figure 2:
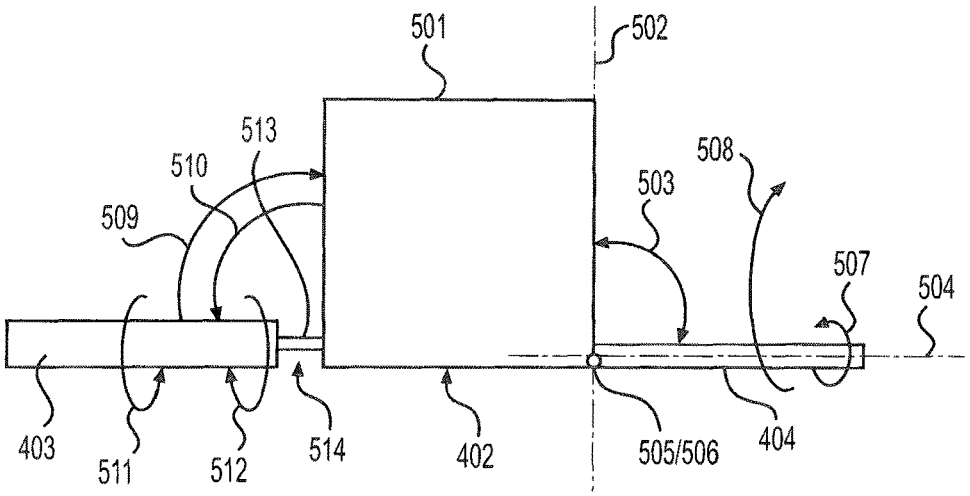
FIG. 2 illustrates a top view of a microphone accessory in accordance with an example embodiment of the invention.

As illustrated in FIG. 2, at least one display member 404 may be hingedly displaceable, in use, from a first position to a second position, and/or from a second position to a first position, in the directions indicated by arrow 503 about a first axis via hinge 505, at or near the edge of the body 501. The display member 404 may be further rotatable about a second axis 504 substantially transverse to the first hinge axis, in the direction of arrows 507 and/or 508.

A display member 403 may rotate in any or all directions as indicated by arrows 509, 510, 511 and 512, and may be spaced from the body 501 by a suitable spacer 513 such as a spacer member or arm 513 such that the member 403 is spaced from the body 501 by a gap or space denoted by 514.

Figure 3B:
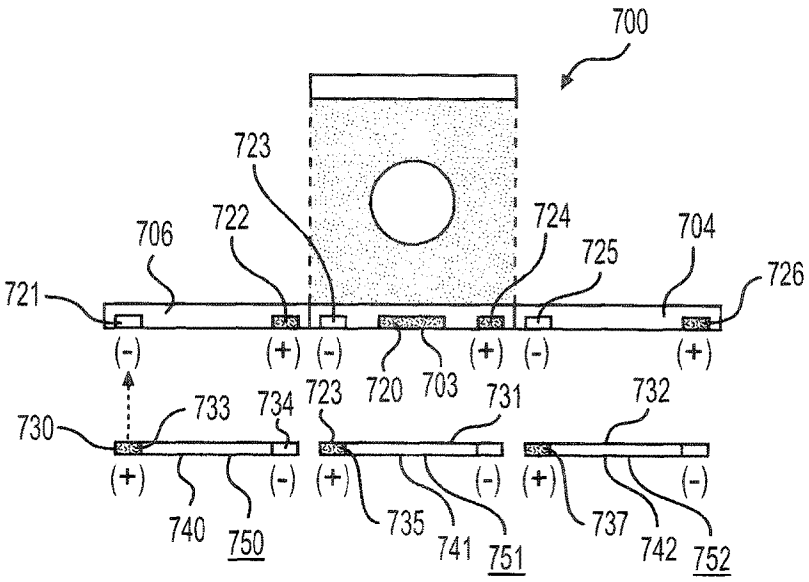
FIGS. 3A-C illustrates top views of a microphone accessory in accordance with an example embodiment of the invention.
Figure 3A:
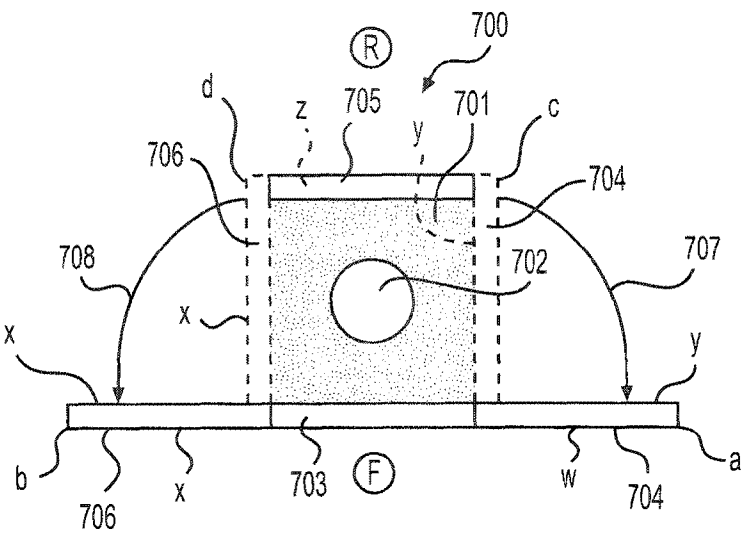

As illustrated in FIG. 3A, microphone accessory 700 may be comprised of foam 701 and a central passage 702 extending through the body 700 into which a microphone handle (not illustrated) may be received, for attachment of the accessory 700 to the microphone. Sides 704 and 706 may be displaceably adjacent to foam 701. When sides 704 and 706 are displaced in the direction indicated by arrows 707 and 708, respectively, from first position c to second position a, and from first position d to second position b, respectively, display members 704 and 706 may leave foam 701 exposed and open to view and may extend display face 703.

When in a first or folded or stowed position, at points c and d, display faces 704 and 706, respectively, may be described as display faces, and when un-folded or deployed to a second position, at points a and b, respectively, display members 704 and 706 may be described as display members. As such, a display face may have at least a dual function of being a display face (when stowed) and a display member (when deployed). When deployed a display member may extend a display face.

In the second position, at points a and b, display members 704 and 706 may display communications w and x towards the front F, respectively. When display members 704 and 708 are rotated 180 degrees, communications w and x may now face towards the rear R, and communications y and z, which previously faced the rear R, now face forwards F, respectively. Significantly, this allows at least two additional communications to be displayed by accessory 700, enabling accessory 700 to generate incremental income from the additional communications. In addition, this means that it is not necessary for a user (usually one in the field) to go back to the office or other location to replace one communication with another communication, say, to replace communication w with communication y. This saves time, money and effort and enables the virtually instant change of a static non-electronically variable communication.

In an alternative embodiment, as illustrated in FIG. 3B, display members 703, 704 and 706 may display at least one communication. Attached to at least one display face of accessory 700 may be at least one magnet 720 or a plurality of magnets 720, 723 and 724. A plurality of display members 706 and 704 of accessory 700 may have attached thereto, permanently or removably, a plurality of magnets, 721 and 722, and 725 and 726, respectively.

In a preferred embodiment, accessory 700 may comprise at least one supplementary display member 730 or a plurality of supplementary display members 730, 731 and 732. At least one supplementary display member may be attached permanently or removably to at least one display member. A supplementary display member may include at least one magnet 733 for permanent or removable attachment to a display member and/or to a display face. A supplementary display member may include and/or display at least one communication, where the communication may comprise at least one static non-electronically variable communication and/or at least one electronically variable communication and/or at least one projected communication and/or at least one electromechanically displaceable communication. A supplementary display member may include at least one static non-electronically variable communication display and/or at least one electronically variable display device and/or at least one other type of display device including at least a projection device and/or an electromechanical display device.

Supplementary display member 730 may be configured to substantially align with at least one display face of accessory 700, for example, supplementary display member 730 may align substantially with display member 706 and may be comprised of substantially the same dimensions and/or surface area as display member 706. Supplementary display member 730 may display at least one communication 750.

The at least one magnet 740 of supplementary display member 730 may have its polarity as positive or negative, and as illustrated in parenthesis magnet 740 has a positive polarity. The matching magnet 721 of display member 706 has a negative polarity as indicated in parentheses. In use, positive polarity magnet 733 of supplementary display member 730 will be attracted to negative polarity magnet 721 of display member 706, thereby acting as the means of attachment of supplementary display member 730 to display member 706, removably or permanently, and so on for the attachment of supplementary display member 751 to display face 720 and the attachment of supplementary display member 752 to display member 704.

Figure 3C:
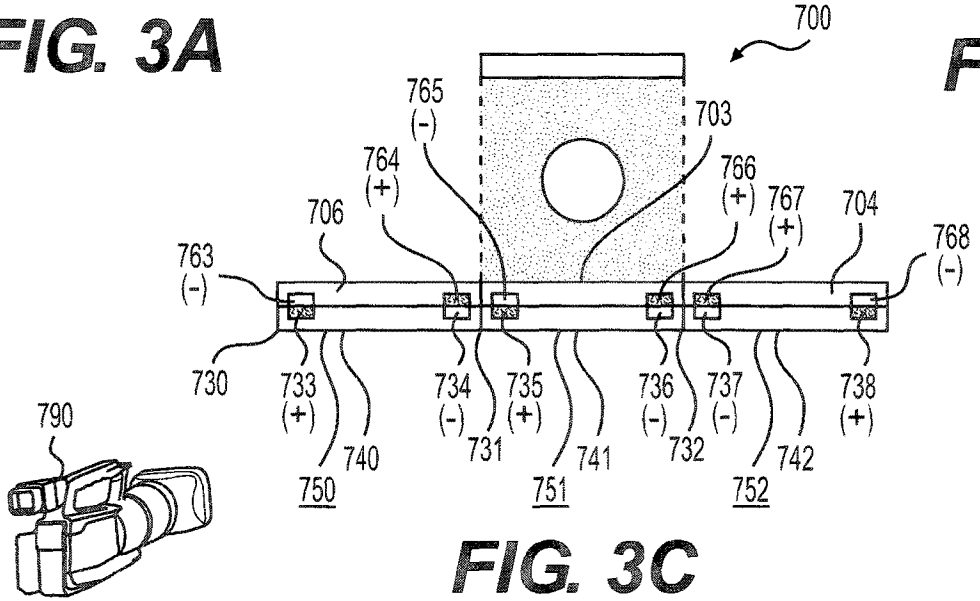

As illustrated in FIG. 3C, a plurality of supplementary display members, 730, 731 and 732 are attached, using magnets, to display member 706, display member 703 and display member 704, respectively.

The display surfaces 740, 741 and 742 of supplementary display members 730, 731 and 732, respectively, may display at least one communication and/or a plurality of communications. For example, in a preferred embodiment, at least one separate communication from separate advertisers, 750, 751 and 752, may be displayed by each supplementary display member 730, 731 and 732, respectively. In an alternative preferred embodiment, communications 750, 751 and 752 may be combined to form a a single coherent communication. At least two sides of the accessory 700 may be combined such that they provide a unified and/or single display area for the display of at least one communication, by at least one display and/or display means. In another exemplary embodiment, communications 750 and 751 may be combined into a single, first communication and/or display area, while communication 752 may comprise a single, second communication and/or display area, and so on. A supplementary display member and/or a display member may not equal the dimensions, area, shape and/or design of a display face, and it may be configured to have a different dimension, area, shape and/or design, and it may be larger or smaller than a display face or display member. A supplementary display member may comprise a two dimensional and/or a three dimensional representation of objects, articles, substances, devices, products, images, advertisements, merchandise, trade names, trade marks, service marks, indicias, communications, intellectual property rights, and may comprise a variety of shapes and sizes, for example, a supplementary display member may be flat and/or substantially planar and/or rounded and/or curved, and/or shaped, and so on.

Figure 4A:
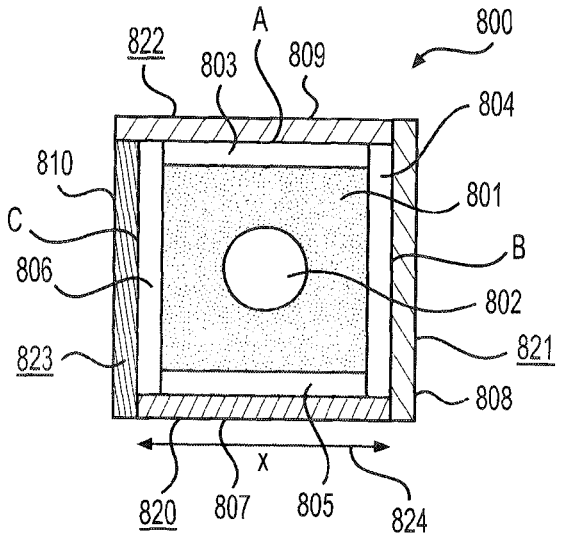
FIGS. 4 A-B illustrates top views of a microphone accessory in accordance with an example embodiment of the invention.

As illustrated in FIG. 4A, accessory 800 may be comprised of foam core 801 (or other suitable material such as rubber and/or plastic fingers) defining a bore 802 through which a microphone handle, stem or stalk may be frictionally received in an axial fashion. A first set of display faces 803, 804, 805 and 806 bounds the foam 801. A second display face 807 and at least one second set of display members 808 and/or 809 and/or 810 may surround and/or be adjacent to the first set of display faces 803, 804, 805 and 806 and may be displaceable as herein envisaged to essentially extend the display surface area of the accessory 800 in accordance with an example embodiment of the invention as will be further explained below.

Body 800 is illustrated in a first or "closed" state. Communication A may be a static communication displayable by display face 803, but is not visible in the first position as it is hidden from by view by display member 809, which may display static communication 822. Communication B may be a static communication displayable by display face 804, but is not visible in the first position as it is hidden from by view by display member 808, which may display static communication 821. Communication C may be a static communication displayable by display face 806, but is not visible in the first position as it is hidden from by view by display member 810, which may display static communication 823. Display face 805 may not display a communication.

Display member 809 may display communication 822 in a first position. Display member 808 may display communication 821 in a first position. Display member 805 may display communication 820 in a first position. Display member 810 may display communication 823 in a first position. The length of communication 820 displayable by display face 805 is, say, x units long.

Figure 4B:
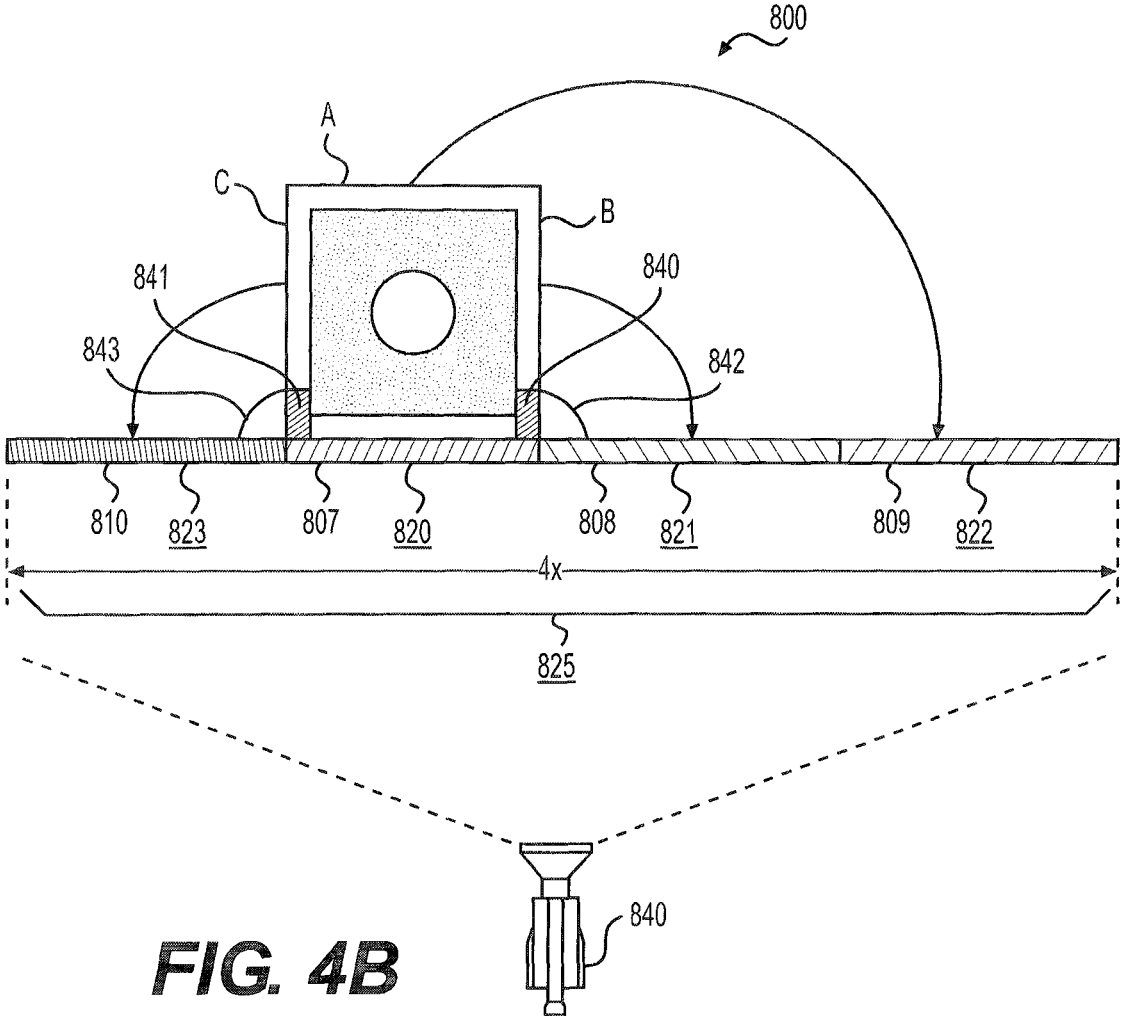

FIG. 4B illustrates microphone accessory 800 in a second or "open" position. Display face 807 has remained in the same position as it was in FIG. 4A, and display member 808, display member 809 and display member 810 have moved into their second positions as shown.

The potential cumulative length of the display area for a single communication, or for a plurality of communications, is now 4× units. This is very important to an advertiser as a larger single communication may be displayed and/or more than one communication may be displayed, at the same time, using the same, single microphone accessory 800, but using the larger 4× area. The accessory 800 comprises the system, means and method to increase the size and/or area and/or shape of its display surface/s.

Communications 823, 820, 821 and 822 may be substantially aligned, adjacent and contiguous with one another, and may planarly extend the display face 807 and/or other display members, for example, display member 809 may planarly extend display member 808. Communications A, B and C may be visible when all the display members 808, 809 and 810 are in their second or open positions, as illustrated. Such deployment may be done manually by a user and/or by using at least one electro-mechanical device/s, such as with the use of at least one electric and/or electronic motor (840, 841) and a mechanical means such as a push/pull rod (842, 843), and may include the necessary electronic circuitry, motor, power supply, software, hardware, programming, timing, sensor/s, hinges, clips, opening and closing means, and so on, or using a program, wired or wirelessly.

It will be understood that a display member may comprise a two dimensional and/or a three dimensional representation of objects, articles, substances, devices, products, images, advertisements, merchandise, trade names, trade marks, service marks, indicias, communications, intellectual property rights, and may comprise a variety of shapes and sizes, for example, a display member may be flat and/or substantially planar and/or rounded and/or curved, and/or shaped, and so on.

Figure 5A:
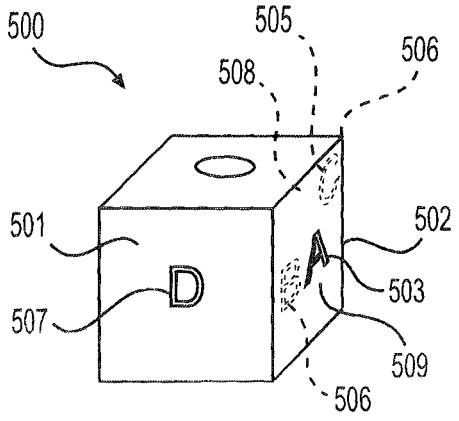
FIGS. 5 A-D illustrates perspective views of a microphone accessory in accordance with an example embodiment of the invention.

As illustrated in FIG. 5A, accessory 500 comprises at least display face 501 that displays static communication D referenced by numeral 507 and display member 502 which displays static communication A referenced by numeral 503 and display face 506 which is hidden from view by display member 502 and which displays static communication C referenced by numeral 505. On the reverse side 508 of display member 502 static communication B referenced by numeral 506 is displayed but is hidden from view by front side 509 of display member 502. Display member 502 is in a first position or in a stowed position.

Figure 5B:
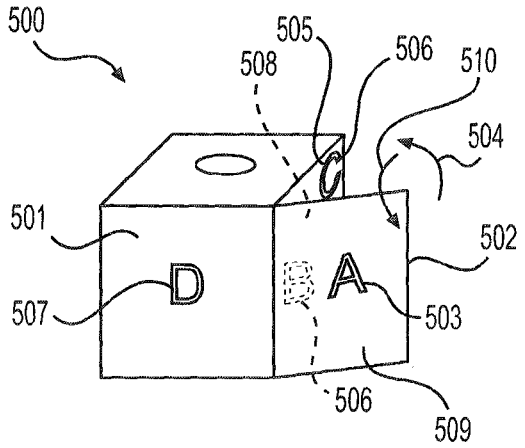

As illustrated in FIG. 5B, display member 502 may be moved in the direction of arrow 504 such that display member 502 may substantially planar to display face 501. By moving display member 502 which displays static communication 503 into substantial alignment with display face 501 which displays static communication 507, display member 502 extends display face 501, and simultaneously reveals static communication 505 on display face 506. Display member 502 may be rotated in the direction of arrows 510 and 504. Display member 502 displays static communication 503 on display side 509 and conceals static communication 506 on reverse display side 508.

Figure 5C:
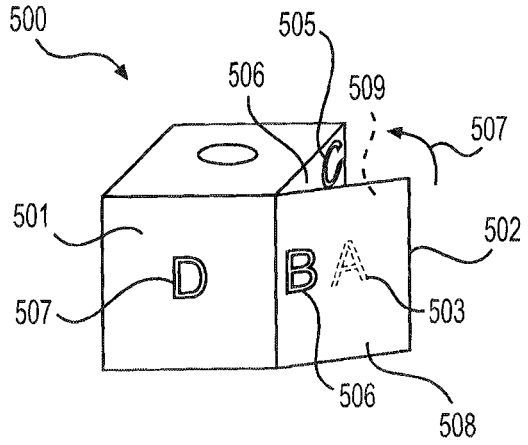

As illustrated in FIG. 5C, display member 502 has been rotated 180 degrees relative to the position indicated in FIG. 5B and as such now displays static communication 506 on ex-reverse display side 508, while simultaneously hiding static communication 503 on ex-front display side 509 from view and static communication 505 is visible on display face 506. Display member 502 which now displays static communication 506 on display side 508 may now be in substantial alignment with display face 501, which displays static communication 507, and display member 502 extends display face 501 and simultaneously reveals static communication 505 on display face 506.

Figure 5D:
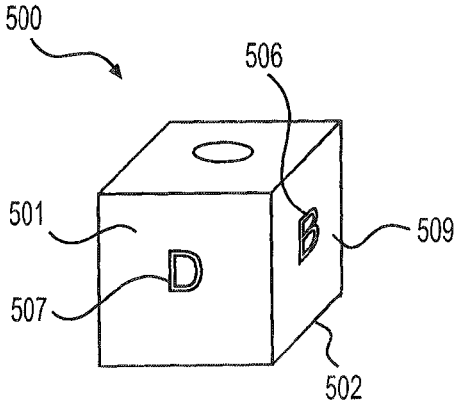

As illustrated in FIG. 5D, display member 502 showing static communication 506 on display side 509 has been moved in the direction of arrow 507 as illustrated in FIG. 5C, and is now in a second or second stowed position. Display face 501 displays static communication 507.

As has been illustrated in FIGS. 5A to 5D, a displaceable display member may extend a display face and/or may enable the speedy changing of at least one communication using a display member and/or may alter the shape of an accessory.

Figure 6:
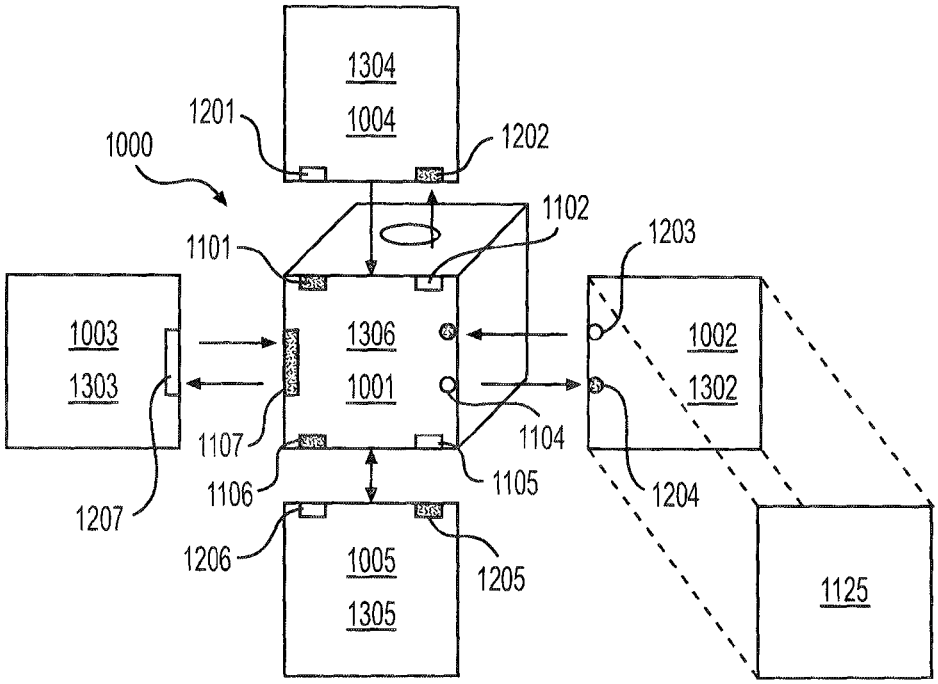
FIG. 6 illustrates a perspective view of a microphone accessory in accordance with an example embodiment of the invention.

In a further embodiment, as illustrated in FIG. 6, accessory 1000 comprises at least one display face 1001. At least one display member 1002 may be attached, permanently or removably, to display face 1001, thereby extending display face 1001.

In a preferred embodiment, a display member may be attached to a display face by magnets, clips, velcro and so on. A second display member may be attached to a first display member, and a third display member may be attached to a second display member, and so on (not illustrated). A first display member may be attached to a first display face and/or a second display member may be attached to the first display face and/or a third display member may be attached to the first display face, and so on.

A second display member 1003 displaying at least one communication 1303 may be attached, permanently or removably, to display face 1001, using magnet 1207 which is attachable to magnet 1107 on display face 1001.

A third display member 1004 displaying at least one communication 1304 may be attached, permanently or removably, to display face 1001, using magnets 1201 and 1202 attachable to magnets 1101 and 1102 on display face 1001, respectively.

A fourth display member 1005 displaying at least one communication 1305 may be attached, permanently or removably, to display face 1001, using magnets 1205 and 1206 attachable to magnets 1105 and 1106 on display face 1001, respectively.

A plurality of display members may be attached to at least one display face. Display members 1002, 1003, 1004 and 1005 may be attached to display face 1001, in substantial alignment with display face 1001, and may planarly extend display face 1001. Without at least one display member attached to at least one display face, the available area of display face 1001 to display a communication is fixed. By attaching at least one display member to display face 1001 the available communication display area of display face 1001 and accessory 1000 is increased and/or the shape and/or dimensions of accessory 1000 may be altered. For example, by attaching display members 1002, 1003, 1004 and 1005 to display face 1001, accessory 1000 may display at least four additional communications, 1302, 1303, 1304, 1305.

As explained earlier, the extension of a display face by use of a display member greatly increases the revenue potential of an accessory, as the incremental display members may display additional advertisements which may be charged for. For example, without the use of extending display members, a user of an accessory, say, a television station broadcaster, would be most reluctant to remove the TV station's call signs from the accessory (using, say, display face 1001). However, by attaching at least one display member, say display member 1002 to display face 1001, the broadcaster may now retain its call sign 1306 while simultaneously displaying at least one advertisement 1302, for which the TV broadcaster may now charge a fee. This allows the broadcaster to monetize otherwise "dead" air time and creates new in-program advertising opportunities for advertisers.

At least one supplementary display member 1125 may be attached to at least one display member 1002, permanently or removably, using magnets, adhesive, velcro, clips or other suitable means. A supplementary display member 1125 may display at least one communication and/or a plurality of communications. A supplementary display member may comprise a two dimensional and/or a three dimensional representation of objects, articles, substances, devices, products, images, advertisements, merchandise, trade names, trade marks, service marks, indicias, communications, intellectual property rights, and may comprise a variety of shapes and sizes, for example, a supplementary display member may be flat and/or substantially planar and/or rounded and/or curved, and/or shaped, and so on.

Figure 7A:
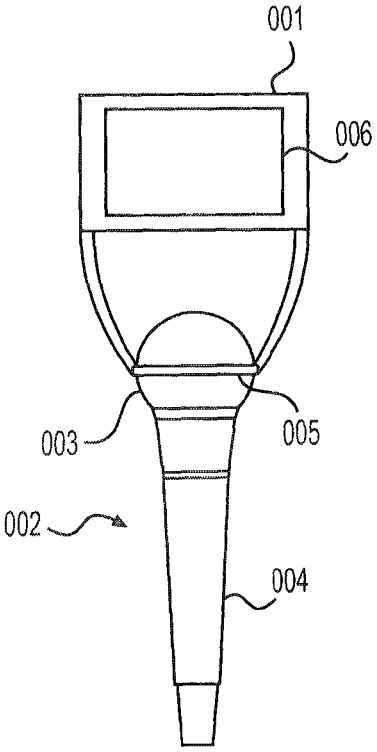
FIGS. 7A and 7B illustrate front views of a microphone accessory in accordance with an example embodiment of the invention.

As illustrated in FIG. 7A, microphone 002 comprises a handle 004 and a head 003. Microphone flag 001 may be attached to microphone head 003 using attachment means 005. Flag 001 may display one static communication 006.

Figure 7B:
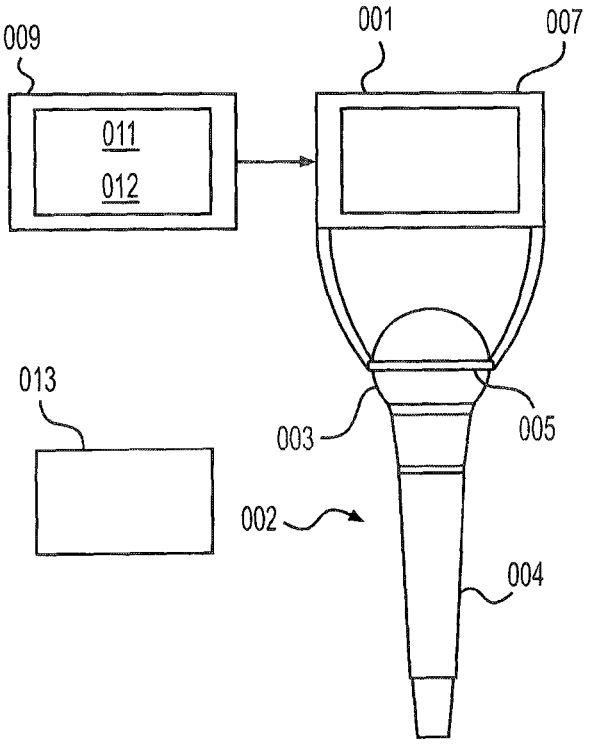

As illustrated in FIG. 7B, display member 009 may be attached to microphone flag's 001 display face 007, thereby extending the display face 007. Display member 009 may display at least one communication 011 or a plurality of communications 011, 012. At least one supplementary display member 013 may be attached, permanently or removably, to at least one display member 009.

Figure 8:
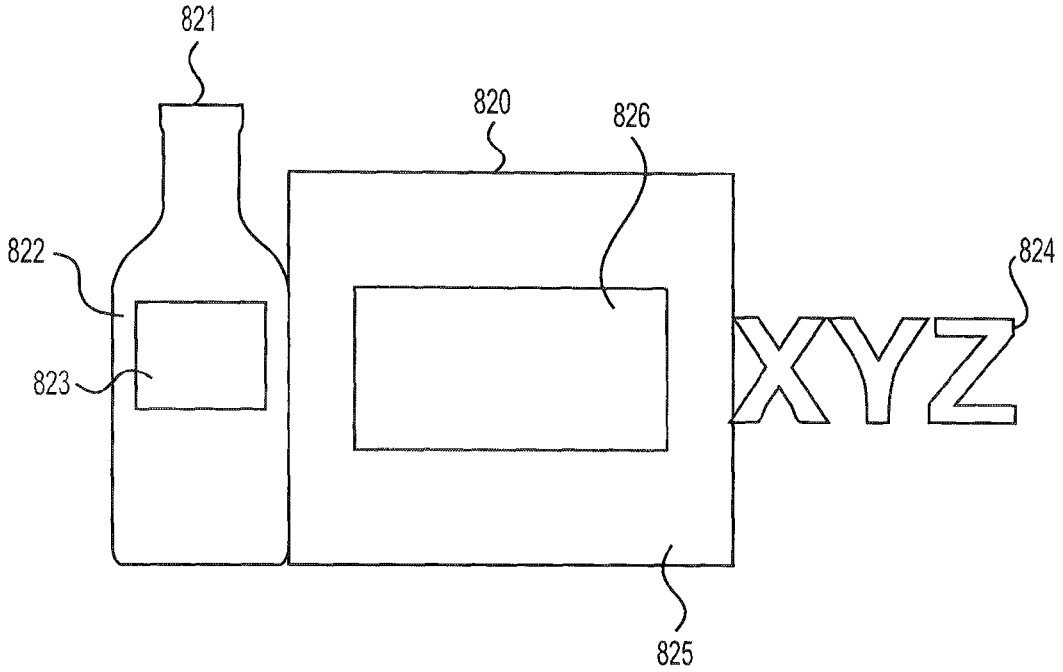
FIG. 8 illustrates a front view of a microphone accessory in accordance with an example embodiment of the invention.

As illustrated in FIG. 8 a display member's area and/or shape and/or size and/or dimensions and/or design may not equal the area and/or shape and/or size and/or dimensions and/or design of a display face, and it may be configured to have a different area and/or shape and/or size and/or dimensions and/or design, and it may be larger or smaller than a display face. A display member may comprise a two dimensional and/or a three dimensional representation of objects, articles, substances, devices, products, images, advertisements, merchandise, trade names, trade marks, service marks, indicias, communications, intellectual property rights, and may comprise a variety of shapes and sizes, for example, a display member may be flat and/or substantially planar and/or rounded and/or curved, and/or shaped, and so on. At least one supplementary display member (2040, 2041) may be attached, permanently or removably, to at least one display member (2018, 2019) and/or to at least one display face.

Accessory 820 may have attached thereto display member 821, permanently or removably, which display member 821 may be shaped to represent an object, such as a bottle 822, which bottle may be in the shape and/or size of an advertiser's product. Display member 821 may be attached to and extend display face 825, which may display at least one communication 826. In addition to the display member 821 may display at least one communication 823, which may be a logo and/or trade mark and/or trade name and so on. At least one additional display member 824 may be attached to accessory 820. Display member 824 may be a trade name, and so on. At least one display member 824 may attach to at least one edge of the accessory 820.

It will be appreciated that a display member may be illuminated or non-illuminated. To this end, each display member may be provided with an internal light source, for example, a light emitting diode (LED), or the like to enable a communication to be illuminated thus more visible in use. It will be understood that in some example embodiments, the body of the microphone is provided with a light source (such as a lamp or LED), wherein light is guided to the display member/s via optical fibre cables, light guides, or the like.

Figure 9A:
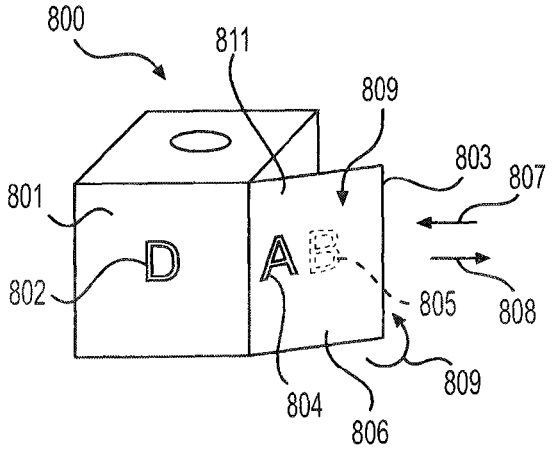
FIGS. 9 A-B illustrates perspective views of a microphone accessory in accordance with an example embodiment of the invention.

As illustrated in FIG. 9A, accessory 800 comprises at least display face 801 that displays static communication D referenced by numeral 802. Display member 803 which displays static communication A referenced by numeral 804 on the front side, and which displays static communication B on the reverse side thereof, referenced by numeral 805, may be permanently or removably attached to accessory 800. Static communication B 805 is not visible as it is hidden from view by front side 806 of display member 803. Display member 803 may be attached to and extend display face 801 in the direction of arrow 807 and may be detached from display face 801 in the direction of arrow 808. Once detached from display face 801, display member 803 may be rotated 180 degrees in the direction of arrows 809.

Figure 9B:
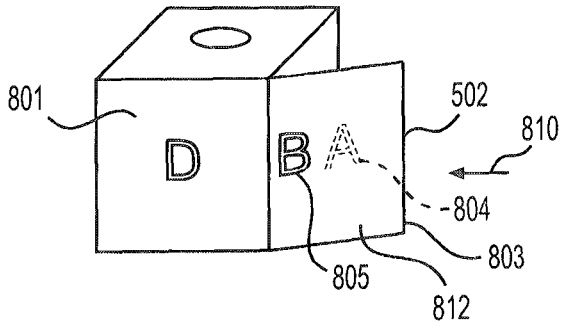

As illustrated in FIG. 9B, having been detached from display face 801, and rotated as discussed in the preceding paragraph, display member 803 may be re-attached to display face 801, in the direction of arrow 810. Consequentially, static communication B 805, which was on the reverse side of display member 803 in FIG. 9A, is now displayed on the front side thereof, and communication A, which was on the front side of display member 803 in FIG. 9A, is now on the reverse side thereof, and is hidden from view.

A display member may comprise at least two display sides 811, 812 for displaying at least one communication on each display side 811, 812. Assuming that the static communication is the same size as the display side, then the accessory's 800 display member 803 may display two static communications. In contrast, for example, a conventional microphone flag, may only display one static communication per display face. This enables the very speedy, usually within seconds, ability of a user of accessory 800 to change a displayed static communication, whereas when using a conventional microphone flag in the field or away from the office or equipment, this would not be possible.

Figure 10A:
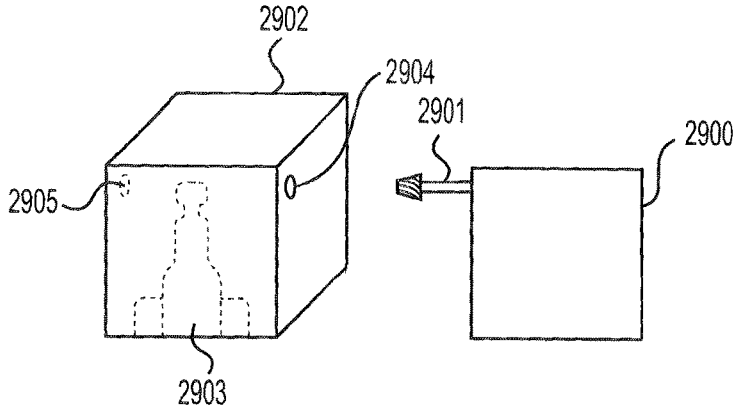
FIGS. 10 A-C illustrates perspective views of a microphone accessory in accordance with an example embodiment of the invention as well as a portion of the microphone accessory.

As illustrated in FIG. 10A, in an alternative preferred embodiment, at least one display member 2900 may comprise at least one attachment device 2901 for attaching and/or coupling display member 2900 to accessory 2902 and to at least one coupling arrangement 2903. Attachment device 2901 may be permanently or removably attached to display member 2900 and/or it may be permanently or removably attached to the arrangement 2903. In one embodiment of the invention, attachment device 2901 is in the form of a rod having a gear head comprising a screw threaded arrangement for complementary engagement with suitable components of the arrangement 2903 (described below) via aperture 2904 in a permanent or removable fashion.

Figure 10B:
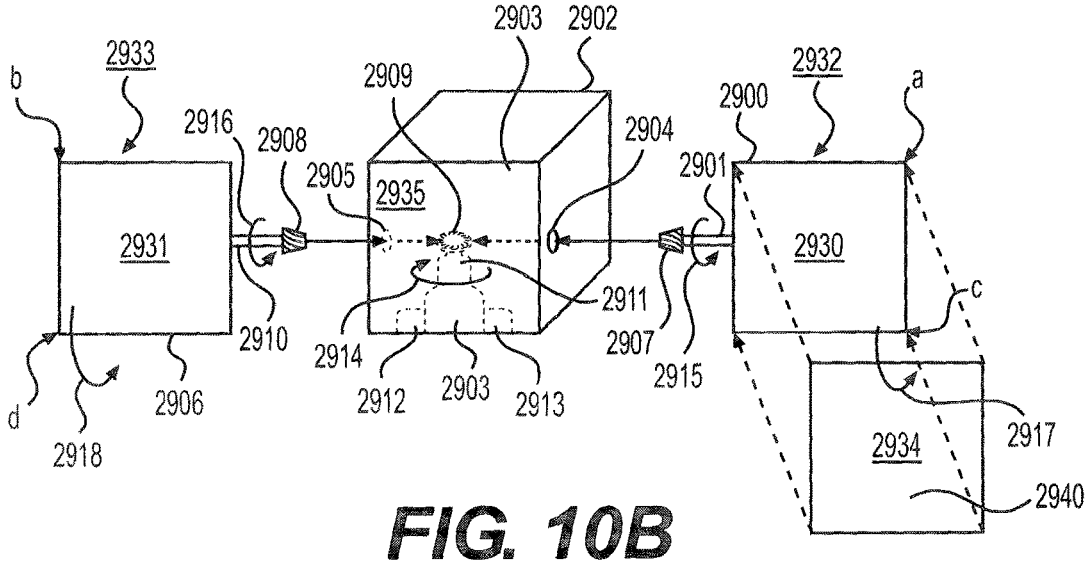

As illustrated in FIG. 10B, two display members, 2900 and 2906, have attached thereto drive shafts or rods 2901 and 2910, respectively. In a preferred embodiment, drive shaft 2910 comprises a screw threaded head or gear head 2908 and drive shaft 2901 comprises a screw threaded head or gear head 2907.

Figure 10C:
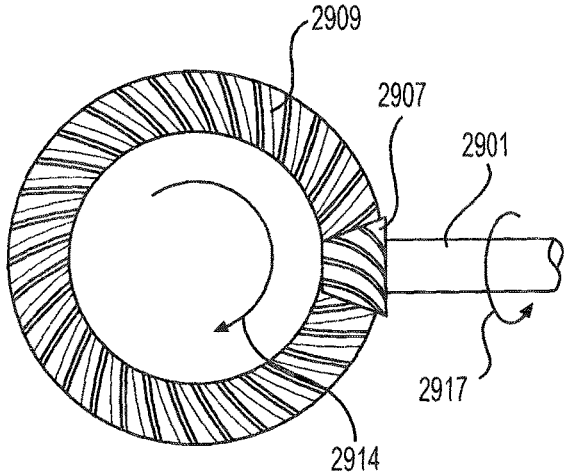

Drive shafts 2901 and 2910 may be extended or inserted through apertures 2904 and 2905, respectively, such that heads 2907 and 2908 connect with or couple with (removably or permanently) a complementary screw threaded gear arrangement of the arrangement 2903 comprising, for example, gear plate/s 2909 of the type illustrated in FIG. 10. C (with only rod 2901 and head 2907 illustrated). The plate 2909 is typically rotatable via motor 2911 and is disposed with its central axis substantially transverse to the longitudinal axes of drive shaft 2901 such that rotation of the plate 2909 in the direction of arrow 2914 (FIG. 10C) translates or causes consequent rotation of the shaft 2901 in the direction of arrow 2917. The arrangement 2903 may include controller 2912 and battery 2913. Motor 2911 may be an electrical motor and/or a mechanical motor. Arrangement 2903 may comprise an electronic and/or electrical system and/or an electromechanical system and/or a mechanical system. If motor 2911 is a mechanical motor, for example, then it may be wound up using a key, which may power a mainspring and/or a torsion spring (not illustrated). The mechanically powered energy may be stored as kinetic energy until required to be used or converted into actual energy, when the force of the mainspring may drive the gears, which may then drive the drive shafts 2901 and 2910, which may in turn drive and rotate the display members 2900 and or 2906, until the kinetic energy is depleted.

Accessory 2902's arrangement 2903 may comprise at least one electric motor, power source, gears, rods, sensors, drive shaft, sensors, rotation sensors, gyroscopes, accelerometer, light sensors, proximity sensors, motion sensors, infrared sensors, temperature sensors, pressure sensors, gear pairs, hyphoid gears, ring gears, differential, spindles, bearings, wires, battery, controller/s, circuitry, computer, clock, timer, hardware, software, memory, receivers, transmitters, wires, antennas and so on (in whole or in part comprising the arrangement 2903).

The gear system may comprise gears 2909 and 2908 and 2907 and may be a hypoid gear system of pairs that connects the motor 2911 to drive shafts 2910 and 2901. The accessory 2902 and arrangement 2903 is configured such that when motor 2911 receives a signal from controller 2912, motor 2911 actuates the arrangement 2903 to cause drive shaft 2901, attached to display member 2900, to rotate in the direction indicated by arrow 2915, and simultaneously (if desired and so instructed by controller 2912) causing drive shaft 2910, attached to extendable side 2906, to rotate in the opposite direction indicated by arrow 2916. Controller 2912 may cause display members 2900 and 2906 to rotate 180 degrees from their starting positions and controller 2912 may further cause display members 2900 and 2906 to hold their positions for a set period of time, say, 10-seconds, and to then rotate another 180 degrees, and hold this position for, say, a second period of 10-seconds, thereby rotating and alternating the display of communications 2930 and 2932 displayed by display member 2900 and thereby rotating and alternating the display of communications 2931 and 2933 displayed by display member 2906. Alternatively, at least two motors (not illustrated) may separately each drive a drive shaft, and the rotation of the motors and their respective drive shafts and their respective display members may be controlled by controller 2912 such that the rotation of the motors and the drive shafts and the display members may be synchronized and/or may rotate in the same direction. Sensors, such as a proximity sensors and/or accelerometers and/or gyroscopes and/or motion sensors, may detect the starting position of display member 2906 and may rotate display member 2906 180 degrees (or any other desired degree of rotation), back to its starting position at 45 degrees to the horizontal plane of side 2963, hold display member 2906 in that position for the desired time period, say 15-seconds, and then rotate display member 2906 by 180 degrees, and so on (not illustrated).

FIG. 10C illustrates a hyphoid gear pair having complementary engaging screw-threading that connects the gears 2909 of motor 2911 to the gear 2907 of drive shaft 2901 of display member 2900. When gears 2909 rotate in the direction of arrow 2914, drive shaft 2901 rotates in the direction of arrow 2917, causing display member 2900 to move in the direction of arrow 2917, thereby causing communication 2932 to replace communication 2930.

Figure 11A:
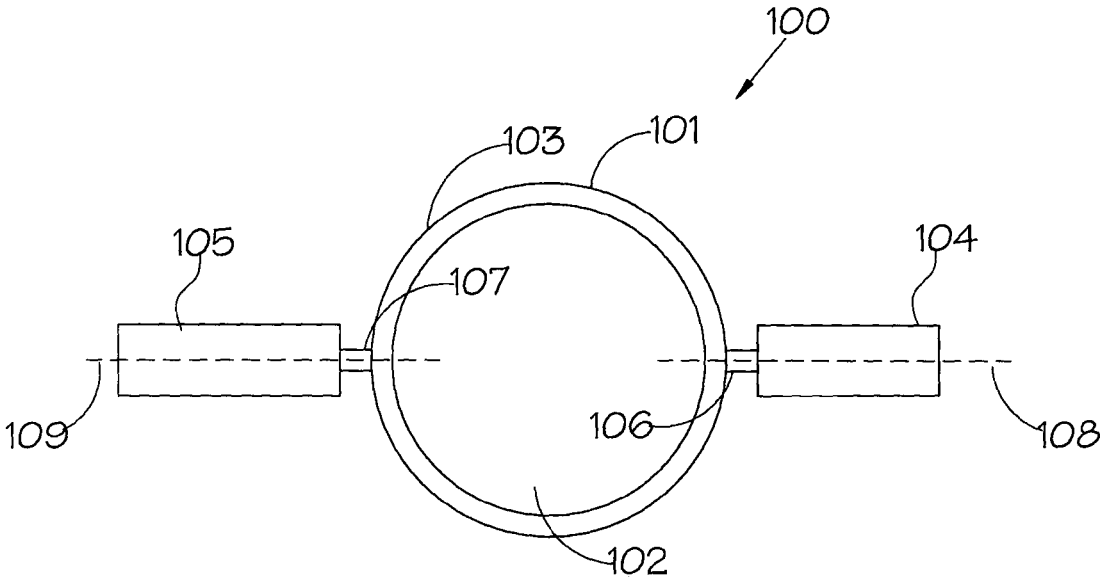
FIGS. 11 A-E illustrates top and front views of various microphone accessories in accordance with example embodiments of the invention.

As illustrated in FIG. 11A, accessory 100 comprises an attaching formation 101 for attaching accessory 100 to the head of a microphone. A central passage 102 extends through the body 103, wherein the head of a microphone is axially receivable therein for attachment thereto, in use. At least one display member 104, or a plurality of display members 104, 105 may be attached to the attaching formation 101, using a hinge 106 or hinges 106, 107. The display members may be rotatable at the hinges 106, 107 about axes 108, 109 respectively.

Figure 11B:
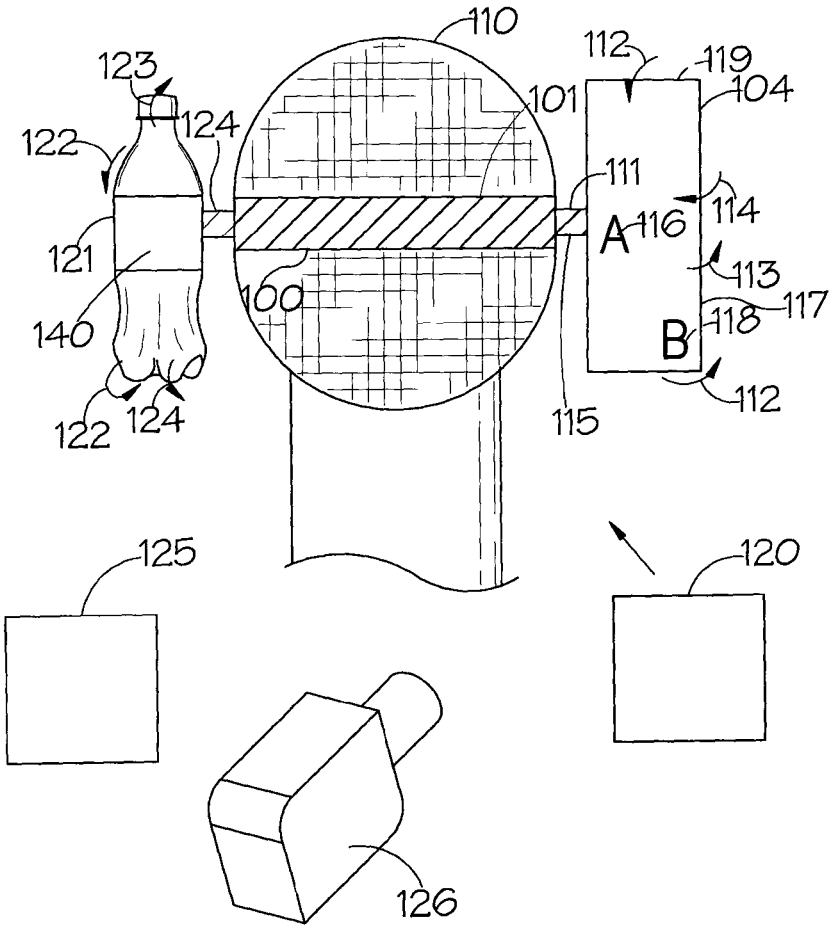

As illustrated in FIG. 11B, accessory 100 may be attached to microphone head 110, permanently or removably, using attachment means 101, wherein the means 101 may be adjustable, expandable, contractable, resiliently flexible, and so on, using adjustable straps, rubber, plastic, stretchable nylon, and so on. Display member 104 may be hingedly attached to attachment formation at 111 and may rotate about an axis in the direction of arrows 112 and/or in the direction of arrow 113 and/or 114. Display member 104 may display at least one communication, using at least one communication device, which communication may be static and/or dynamic and/or electronically variable and/or projected and/or virtual and/or augmented, and so on. There may be a space or spacer 115 between the attaching formation 101 and the display member 104. Display member 104 may display at least a first communication A referenced by numeral 116 on the first side 117 and at least a second communication B referenced by numeral 118 on the second side 119 or reverse side 119. In the first position communication 116 is visible and second communication 118 on second side 119 is hidden and is not visible. When rotated 180 degrees, display member 104 will display communication 118 and communication 116 will be hidden from view. At least one supplementary display member 120 may be attached to display member 104. Accessory 100 may be filmed by camera 126 and transmitted to an audience for viewing using a plurality of display devices.

Display member 121 may comprise a two dimensional and/or a three dimensional representation of objects, articles, substances, devices, products, images, advertisements, merchandise, trade names, trade marks, service marks, indicias, communications, intellectual property rights, and may comprise a variety of shapes and/or sizes, for example, a display member may be flat and/or substantially planar and/or rounded and/or curved, and/or shaped, and so on. Display member 121 may be hingedly attached to attachment formation at 101 at 124 and may rotate about an axis in the direction of arrows 122 and/or in the direction of arrow 123 and/or 124.

Display member 121 may display at least one communication 140, using at least one display and/or display device, which communication 140 may be static and/or dynamic and/or electronically variable and/or projected and/or virtual and/or augmented, and so on. There may be a space or spacer 124 between the attaching formation 101 and the display member 121. At least one supplementary display member 125 may be attached to display member 121.

Figure 11C:
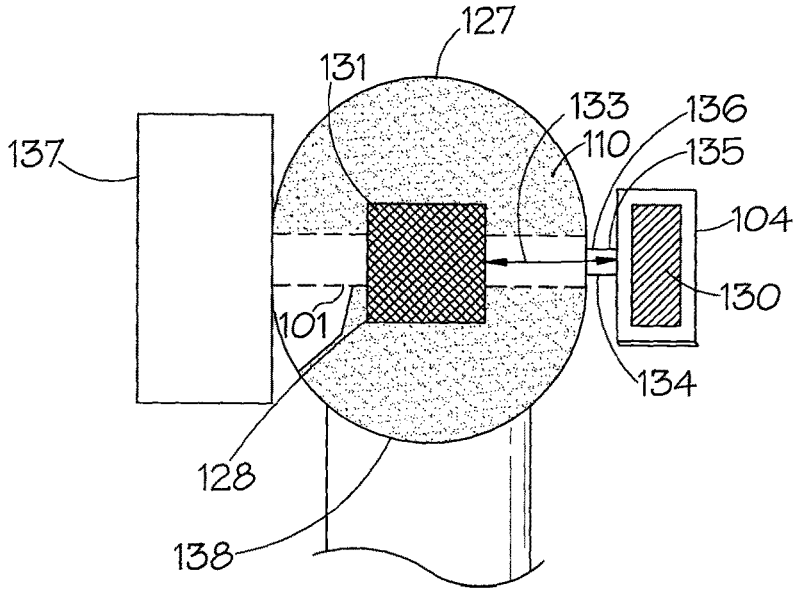

As illustrated in FIG. 11C, microphone windshield 127 covers microphone head 110 as well as attachment formation 101. Windshield 127 may display at least one communication 131, using at least one display face 128, which first communication 131 may be a static communication and/or a dynamic communication and/or an electronically variable communication, and so on. At least one display member 104 may be attachable, permanently or removably, to the attachment formation 101, or a plurality of display members 104 and 137. Display member 104 may be spaced from the body 101 and/or from at least one communication 131 displayed by windshield 127 by way of a suitable spacer 134 and/or space 133 and/or hinge 135 and/or rod 136. Display member 104 may not be contiguous to display face 128, but may be in relatively close proximity to display face 128, such that, in use, a viewer may determine and/or perceive that the display member 104 may extend the display face 128 and/or that the first communication 131 may be linked, directly or indirectly, to the second communication 130 displayed by display member 104. For example, first communication 131 displayed using the windshield 127 may display the advertisers brand name, say "ABC BRAND" and the display member 104 may display a second communication 130, a static image of the ABC BRAND's product, say a soft drink. A viewer may link the first communication 131 with the second communication 130, thereby creating a "virtual" or perceived adjacency of the display face 128 with the display member 104. As such, the display member 104 (virtually) extends the display face 128. Attachment formation 138 may be a hollow opening in windshield 127 into which the microphone head 110 may be axially fitted.

It will be appreciated that the windshield 127 may have lateral slots or apertures so as to accommodate the spacer 134 while operatively covering the head of the microphone.

Figure 11D:
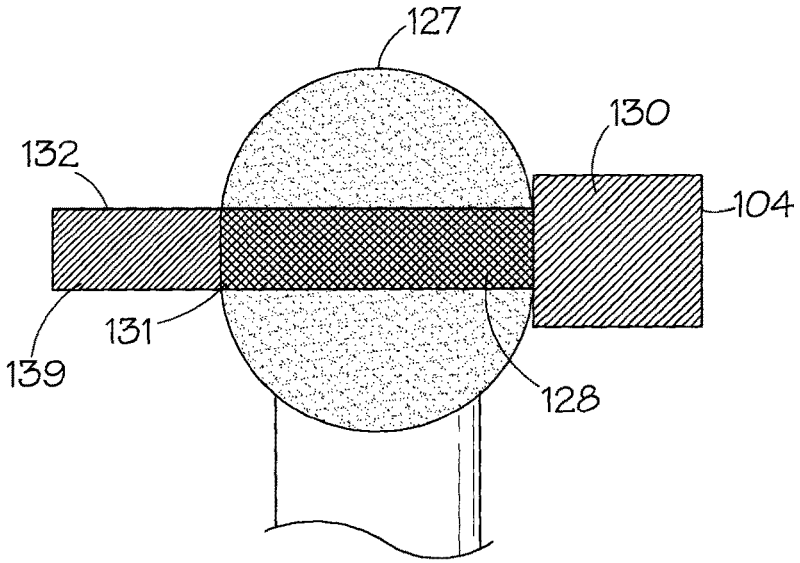

As illustrated in FIG. 11D, first communication 131 is displayed using microphone windshield 127. Second communication 130 is displayed using display member 104. Display member 104 is adjacent to display face 128 and/or first communication 131. First communication 131 may be adjacent to second communication 130 and/or to third communication 139 displayed by display member 132. Display member 104 may extend display face 128 and display member 132 may extend display face 128. Second communication 130 and/or third communication 139 may extend first communication 131.

Figure 11E:
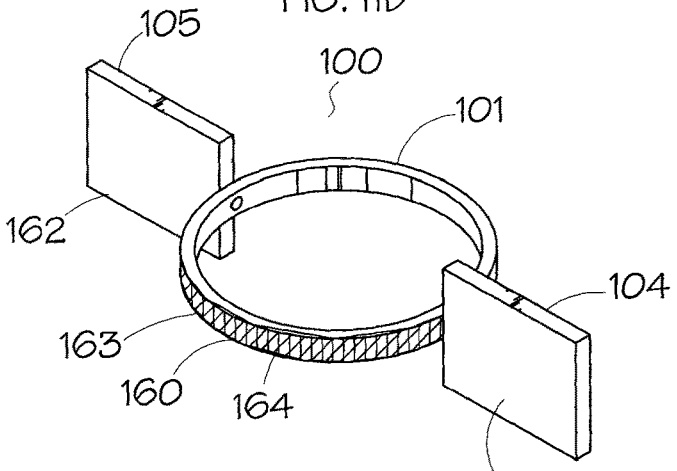

As illustrated in FIG. 11E, attachment formation 101 may comprise at least one display area 160 for displaying at least one communication. Accessory 100 or body 100 may comprise at least one display member 104, or a plurality of display members 104 and 105, which may extend display face 163. A display panel providing a first communication 164 may be displayed using attachment formation 101. A second communication 161 may be displayed using display member 104. A third communication 162 may be displayed using display member 105. Display member 104 may be adjacent to display face 163 and/or first communication 164. Display member 105 may be adjacent to display face 163 and/or first communication 164. Display member 104 may extend display face 163. Display member 105 may extend display face 163. First communication 164 may be adjacent to second communication 161 displayed by display member 104 and/or to third communication 162 displayed by display member 105. Second communication 161 and/or third communication 162 may extend first communication 164. Display member 104 may extend display face 163 and/or display member 105 may extend display face 163.

Though not illustrated, it will be appreciated that a windshield may be attachable to a microphone head comprising the accessory 100 or body 100 as described with reference to FIG. 11E. However, it will be appreciated that in addition to a central aperture for receiving the head of the microphone axially therein, the windshield may comprise slots for accommodating the members 104, 105 so as to fit onto the head of the microphone with the accessory 100 thereon, and/or the windshield may also comprise at least one aperture which may substantially align, in use, with the at least one communication 164 displayed using at least one display area and/or display panel/s of the attachment formation 101, such that the at least one communication 164 may be displayed through the at least one aperture of the windshield. It will be noted that in this example embodiment, the windshield may or may not have at least one communication displayed thereon.

Figure 12:
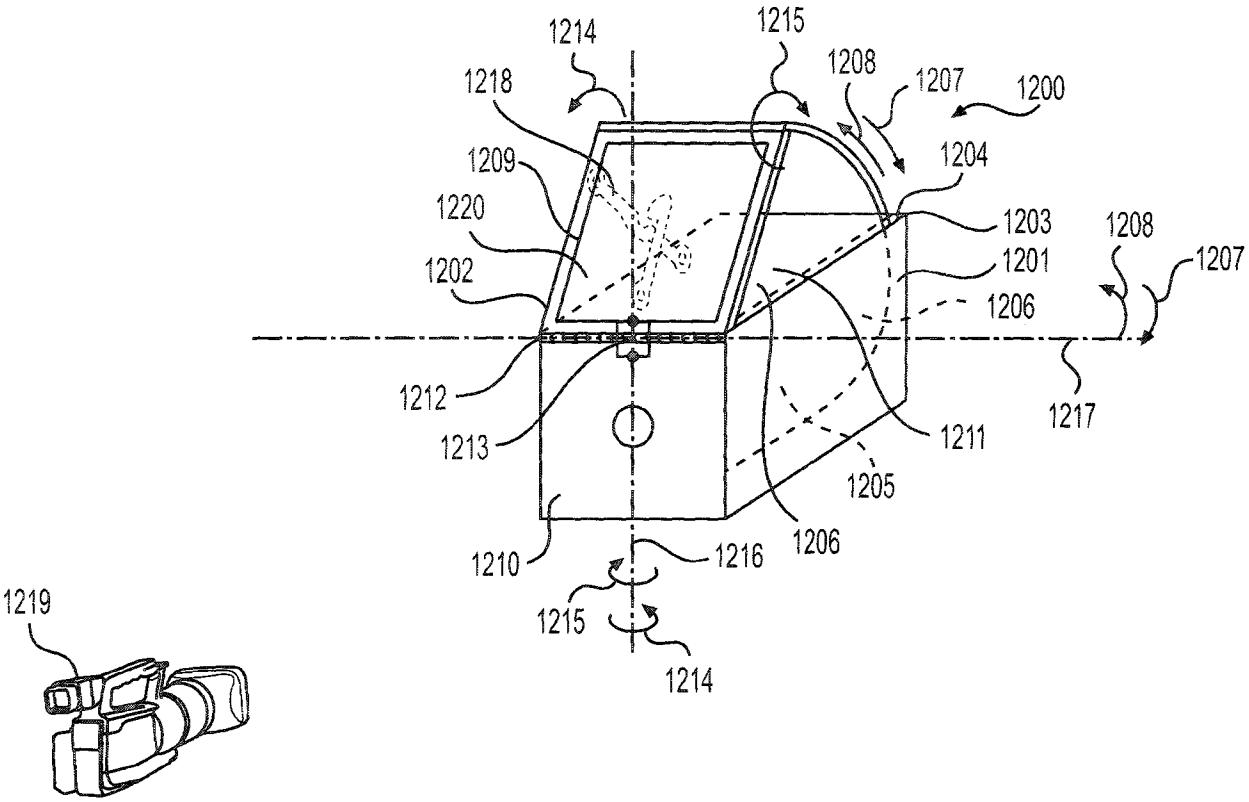
FIG. 12 illustrates a perspective view a microphone accessory in accordance with an example embodiment of the invention.

As illustrated in FIG. 12, microphone accessory 1200 may be cuboid or triangular in shape. At least a first display face 1201 may display at least one communication. First display face 1201 is not movable or displaceable. Second display face 1202 may be movable and/or displaceable about at least one axis. Second display face 1202 may be attachable to at least one hinge 1212 which enables second display face 1202 to move in the direction of arrows 1207 and/or 1208 about axis 1217 and/or second display face 1202 may move in the direction of arrows 1214 and/or 1215 about axis 1216.

Side 1203 may comprise an opening 1204 into which side panel 1206 of display face 1202 may fit and may frictionally engage therewith such that when in an open position, as illustrated, display face 1202 will remain in position, which position may be adjusted according to the desire of a user. Side panel 1206 may be moved in the direction of arrows 1207 and/or 1208, that is, into or out of receiving aperture 1204, respectively, in use, thereby moving down second display face 1202 into a first or closed position such that the display face 1209 may be substantially perpendicular to first display face 1201. Side panel 1206 may display at least one communication 1211 when second display face 1202 is in a second position, thereby effectively extending first display face 1201. Importantly, should accessory 1200 be in a substantially horizontal plane, such as in a news conference, display member 1202 may be lifted into a second position, substantially as illustrated, thereby allowing camera 1219 to film communication 1220 displayed by display member 1202 and transmit such filming to an audience of viewers, whereas if display member 1202 was not moved into a second position, and remained in a substantially horizontal plane, perpendicular to side 1201, camera 1219 would not be able to film communication 1220 and communication 1220 would not be transmitted to the audience of viewers.

In an alternative embodiment, second display side 1202 may comprise a hinge and may be in the form of a display member displaceable to extend or supplement the display of the microphone accessory 1200 substantially in a similar manner as described above in other example embodiments. A microphone may comprise the necessary attachment means and/or formations with which to attach a microphone accessory thereto, permanently or removably, for example a microphone may comprise a clip-on, clip-off formation, frictional engagement means and/or formation, and so on (not illustrated).

The invention addresses the problems outlined above by enabling a microphone accessory to display at least one additional communication or advertisement, for which the user or broadcaster may charge. By charging third party advertisers for the display and broadcast of their advertisements to the broadcaster's audience of viewers, the broadcaster is now able to monetize previously "dead" air time and generate an incremental revenue stream for itself, without the need to create additional, expensive content. The invention also creates new in-program advertising opportunities for advertisers.

The invention claimed is:

1. A microphone accessory (401) for use with a microphone (400), the microphone accessory comprising:

a body having at least one first display face (402) for displaying at least a first communication (430);

at least one attachment formation (441) for attaching the body to the microphone;

wherein the microphone accessory (401) is additionally characterized by at least one display member (2900) for displaying at least a second communication; and at least one attachment means for attaching the display member (2900) permanently or removably to a second display face (404);

characterized in that the microphone accessory is further comprised of:

the display member attached to the second display face where the attached display member is configured to extend the second display face;

and wherein the display member attached to the second display face may be rotated (2915) about a horizontal axis or displaced manually or electro-mechanically, where if the displacement is electro-mechanical then the electro-mechanical displacement may be in response to a suitable control signal; and where the display member may be held in a certain manual or electro-mechanical displaced position for a desired time period.

2. The microphone accessory as claimed in claim 1, wherein the at least one display member is a shaped display member, wherein the shaped display member is selected from a group comprised of indicia, product brand, trade name, image, communication and advertisement.

3. The microphone accessory as claimed in claim 1, wherein the at least one display member is selected from the group comprising at least one static display suitable for displaying a static non-electronically variable communication and at least one non-static electronic display device suitable for displaying at least one electronically variable communication.

4. The microphone accessory as claimed in claim 1, wherein the microphone accessory comprises suitable circuitry, software, hardware, drivers, power source, control signal and processor operable to control the accessory electro-mechanically.

5. The microphone accessory as claimed in claim 1, wherein the display member is displaceably attachable to the accessory.

6. The microphone accessory as claimed in claim 1, wherein the static non-electronically variable display member may be selected from the group comprised of printed media and two-dimensional object and three-dimensional object.

7. The microphone accessory as claimed in claim 1, wherein the accessory comprises attaching formations selected from the group at least comprising of magnetic attachment and frictional engagement and adhesive and clip on-clip off, for removably attaching the display member thereto, in use.

8. The microphone accessory as claimed in claim 1, wherein the display member is spaced from the accessory by way of a suitable spacer.

9. A method of using a microphone, the method comprising:

providing a microphone accessory (401) onto a microphone (400), wherein the microphone accessory comprises at least one body having at least one display face (402) for displaying at least a first communication (430) and at least one attachment formation (441) for attaching the microphone accessory to the microphone wherein the method is additionally characterised by configuring at least one display member (2900) for displaying at least a second communication; and at least one attachment means for attaching the display member permanently or removably to a second display face (404)

where the display member attached to the second display face is configured to extend the second display face; and where the display member attached to the second display face may be rotated (2915) about a horizontal axis or displaced manually or electro-mechanically, where if the displacement is electro-mechanical then the electro-mechanical displacement may be in response to a suitable control signal; and where the display member may be held in a certain manual or electro-mechanical displaced position for a desired time period.

10. The method as claimed in claim 9, wherein the at least one display member is a shaped display member, wherein the shaped display member is selected from a group comprised of indicia, product, brand, trade name, image, communication and advertisement.

11. The method as claimed in claim 9, wherein the display member is selected from a group comprising at least one static display suitable for displaying a static non-electronically variable communication and at least one non-static electronic display device suitable for displaying at least one electronically variable communication.

12. The method as claimed in claim 9, wherein the display member is displaceably attachable to the accessory.

13. The method as claimed in claim 9, wherein the display member is spaced from the accessory by way of a suitable spacer.

* * * * *